US005186507A

United States Patent [19]

Neidfeld

[11] Patent Number: 5,186,507

[45] Date of Patent: Feb. 16, 1993

[54] SPACKLING TOOL WITH TOOL HOLDERS

[75] Inventor: Matthew A. Neidfeld, 240 Bernice Dr., East Meadow, N.Y. 11554

[73] Assignee: Matthew A. Neidfeld, East Meadow, N.Y.

[21] Appl. No.: 847,828

[22] Filed: Mar. 6, 1992

[51] Int. Cl.[5] ..... E04G 21/02

[52] U.S. Cl. ..... 294/3.5; 294/146; 294/172

[58] Field of Search ..... 294/3.5, 143, 144, 146, 294/172; 15/235.4, 235.5, 235.6, 235.7, 235.8, 257 R, 257.05, 257.06; 248/441.1, 451–453; 206/1.7; 7/105, 167

[56] References Cited

U.S. PATENT DOCUMENTS

| | | | |
|---|---|---|---|
| 289,700 | 12/1883 | Parker | 248/441.1 |
| 832,036 | 10/1906 | Bunker . | |
| 963,143 | 7/1910 | Hansen et al. . | |
| 1,348,516 | 8/1920 | Peck . | |
| 1,609,704 | 12/1926 | Ellis | 15/235.4 |
| 1,773,437 | 8/1930 | Riege | 294/3.5 |
| 3,790,201 | 2/1974 | Morsilli | 294/3.5 |
| 4,266,686 | 5/1981 | Carter | 15/257 R X |
| 4,753,471 | 6/1988 | Gringer . | |

FOREIGN PATENT DOCUMENTS

| | | | |
|---|---|---|---|
| 213666 | 11/1955 | Australia . | |
| 494435 | 10/1938 | United Kingdom | 15/257 R |

*Primary Examiner*—Johnny D. Cherry
*Assistant Examiner*—Dean J. Kramer
*Attorney, Agent, or Firm*—Hoffmann & Baron

[57] ABSTRACT

A plasterer's hawk which preferably includes spring clips or other retaining members on the under side of the blade for holding putty and/or spackling knives or plaster spreaders. Two, three, four or more spring clips or other suitable retaining members can be circumferentially attached on the under side of the plasterer's hawk in order to hold the knives or spreaders under spring tension. The spring clips can be made of stainless steel, plastic or other non-corrodible material. The handle can be made as pistol grip from a soft rubber or injected molded plastic. A soft rubber foam gasket can be placed between the handle and under-side of the blade.

15 Claims, 4 Drawing Sheets

HANDLE (A)

HANDLE (B)

HANDLE (C)

SPACKLING TOOL WITH TOOL HOLDERS

The present invention is a continuation in part of U.S. Pat. No. application 07/747,912 filed Aug. 19, 1991.

BACKGROUND OF THE INVENTION

1. Field of the Invention

This invention relates to a spackling tool which has tool holders on its underside for retaining tools such as spackling and putty knives.

2. Background of the Related Art

The basic spackling tool, called a Plasterer's Hawk, has remained relatively unchanged since the turn of the century. One of the earlier improvements is described in U.S. Pat. No. 832,036 to Bunker which issued in 1906. Bunker describes a board forming the top surface of the Plasterer's Hawk and a handle. The back of board is cut with a tapered dovetailed groove to receive a similar shaped slide to prevent the warping of the top. A felt pad is attached to the underside of the board to form a comfortable hand rest. The hand rest and the flat upper board surface are rotatable relative to each other without rubbing the plasterer's hand.

Another improvement to the basic plasterer's hawk is disclosed in U.S. Pat. No. 963,143 to Hansen et al. It describes a plasterer's hawk with a removable handle. An indentation in the upper side of a flat table that supports the plaster protrudes through the table to receive an insert which is threaded to receive a bolt. A long threaded bolt which protrudes through the length of the handle attaches the handle to the insert in the table. A pad is positioned on the top of the handle between the handle and the bottom of the table in order to protect the hand of the user. The handle can be removed for shipping by unscrewing the long bolt.

An improvement to Hanson et al's embodiment is a hawk that includes a resilient support on the top of the handle formed from an inflatable annular ring. This hawk with a pneumatic hand cushion is described in U.S. Pat. No. 1,348,516 to Peck which issued on Aug. 3, 1920. The pneumatic hand cushion is preferably formed of rubber fabric and can be inflated through a valve.

A recent improvement to the basic plasterer's hawk is described in U.S. Pat. No. 4,753,471 to Gringer which issued on Jun. 28, 1988. The hawk has a flat work surface and a handle which can be removably mounted to the underside of the blade in a plurality of different positions for use, storage, packing or display. The handle includes a pair of holes on its side which snap-fit together with mushroom pins on the bottom of the work surface to facilitate mounting of the handle in a storage and/or hanging position. The handle can also be threadably mounted to the blade in a working position.

Each of the plasterer's hawks described above are useful for plastering and spackling walls and/or ceilings under ordinary circumstances. During plastering, however, various sizes blades are required depending on the size or angle of the holes or cracks being filled. Accordingly, when large ceiling areas are plastered over prolonged periods of time, and when the plasterer is working on higher portions of walls, it is inconvenient for the worker to reach down to a utility belt or tool box to obtain various size plastering and putty knives for spreading and smoothing the plaster or spackling material. This is especially difficult when a plasterer is on top of step-ladder or scaffolding and there is a considerable mass of wet plaster or spackling compound on the upper surface of the hawk.

Accordingly, it would be desirable to provide a plasterer's hawk which can hold various size putty and spackling knives in close proximity to the plasterer's hand.

It also would be desirable to maintain the putty and spackling knives attached to the plasterer's hawk during storage and transportation between work sites so that they are easy to locate for cleaning and/or use.

SUMMARY OF THE INVENTION

These and other purposes are achieved by the present invention which provides a plasterer's hawk which preferably includes spring clips or other retaining means on the under-side of the blade for holding putty and spackling knives or plaster spreaders. Two, three, four or more spring clips or other suitable retaining means can be circumferentially placed on the under-side of the plasterer's hawk in order to hold the knives or spreaders under spring tension. The spring clips can be made of stainless steel, plastic or other suitable non-corrodible material. The handle can be made as a pistol grip from a soft rubber or injection molded plastic. A soft rubber foam gasket can preferably be placed between the handle and the underside of the blade.

For better understanding of the present invention reference is made to the following description taken in conjunction with the accompanying drawings, the scope of which is pointed out in the appended claims.

DETAILED DESCRIPTION OF THE PREFERRED EMBODIMENTS

Figure 1:
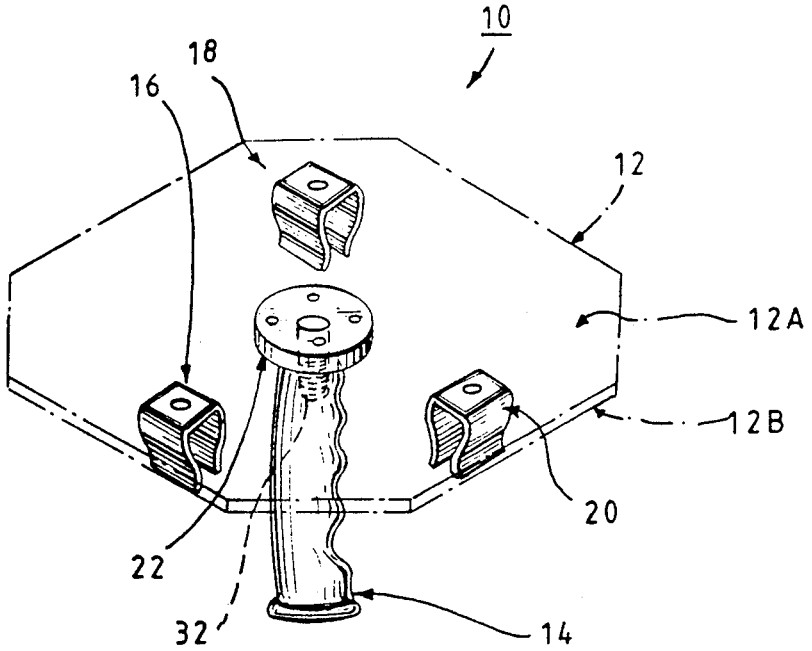
FIG. 1 is a perspective view illustrating the preferred plasterer's hawk according to the present invention, the octagonal blade is shown in phantom to illustrate the spring clips on the bottom surface of the blade.
Figure 2:
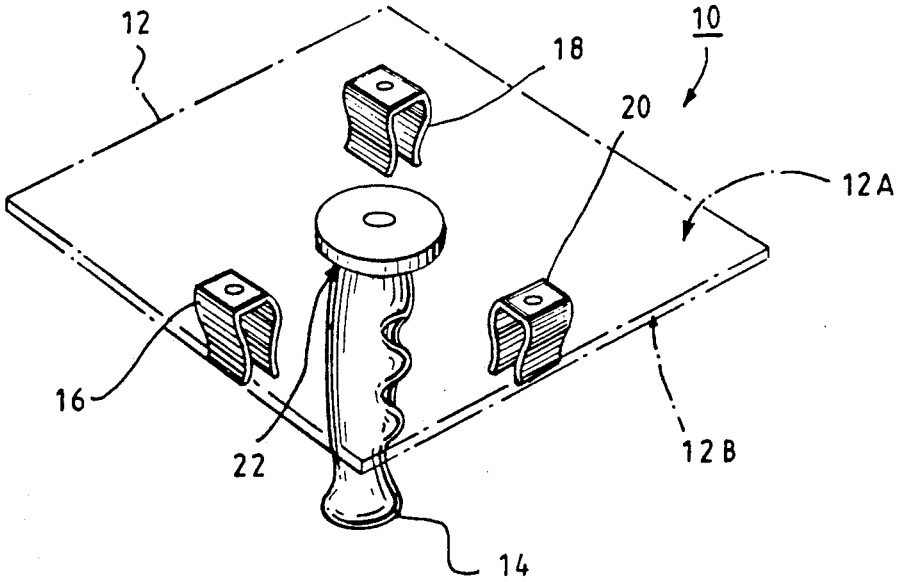
FIG. 2 is a perspective view of another embodiment of the present invention, with a square blade.
Figure 3:
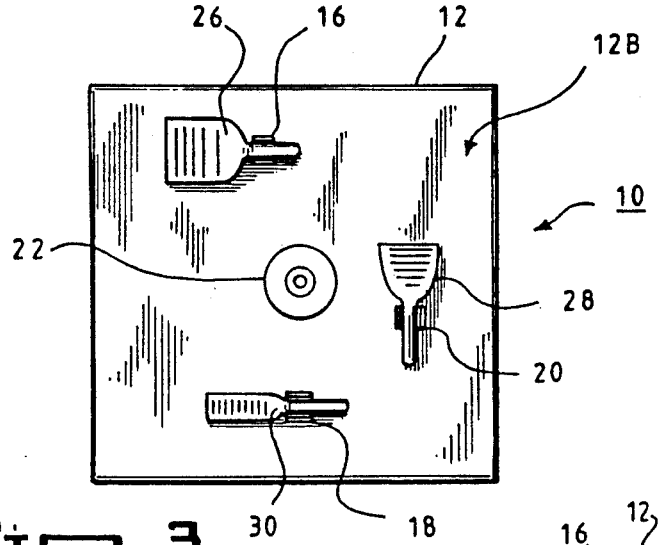
FIG. 3 is a bottom plan view of the plasterer's hawk of FIG. 2, illustrating three plastering/spackling knives disposed within the clips on the under side of the blade.
Figure 7B:
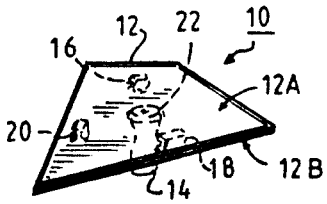
FIG. 7B is an elevated perspective view of another embodiment of the plasterer's hawk of the present invention having an irregularly shaped blade.
Figure 7A:
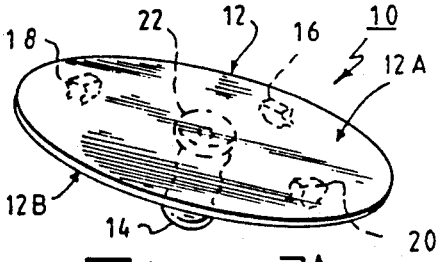
FIG. 7A is an elevated perspective view of another embodiment of the plasterer's hawk of the present invention having an elliptical blade.
Figure 7C:
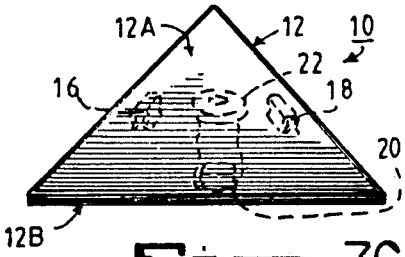
FIG. 7C is an elevated perspective view of another embodiment of the present invention having a triangular blade.
Figure 7D:
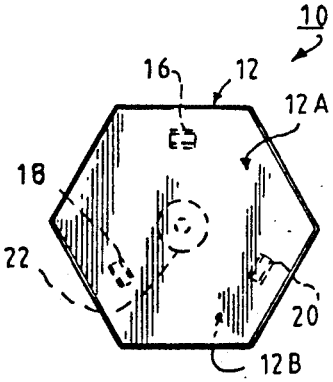
FIG. 7D is a top plan view another embodiment of the present invention having an hexagonal blade.
Figure 7E:
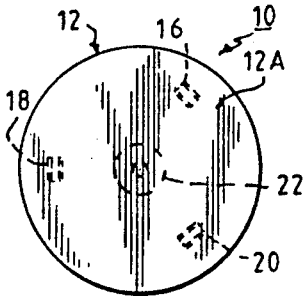
FIG. 7E is a top plan view of another embodiment of the present invention having a circular blade; and, FIG. 7F is a top plan view of another embodiment of the present invention having a pentagonal blade.
Figure 7F:
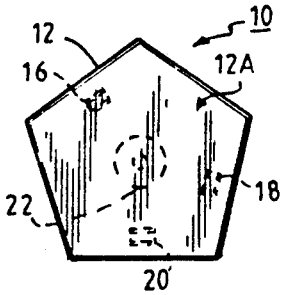

A preferred plasterer's hawk with tool holders 10 for plastering and/or spackling in accordance to the present invention is illustrated in FIG. 1. The plasterer's hawk 10 includes a blade 12 with a flat upper work surfacer 12A and a bottom surface 12B. The preferred plasterer's hawk 10 shown in FIG. 1 has an octagonal shaped blade 12. Another preferred embodiment of the plasterer's hawk 10' in accordance with the present invention is illustrated in FIGS. 2 and 3, in which the shape of the blade 12 is square. FIG. 2 is a perspective view of the plasterer's hawk 10' taken shown from the same perspective as FIG. 1; while FIG. 3 is a bottom plan view of the alternative embodiment of the preferred plasterer's hawk 10' of the present invention which is illustrated in FIG. 2. The preferred plasterer's hawk 10 (or the alternate preferred embodiment 10') includes a blade 12 with a flat upper work surface 12A and a bottom surface 12B. A handle 14, and spring clips or other retaining means 16, 18, 20 and optionally a fourth retaining means (not shown) are circumferentially attached to the bottom blade surface 12B for retaining putty or spackling knives 26, 28 and 30, respectively. The clips 16, 18 and 20 or other retaining means may be fabricated from stainless steel, resilient plastic, composite or other suitable materials which will not corrode, or they may include other types of retaining means such as VELCRO® (hook and loop) material, magnetic, mushroom clips, bayonet clips or other means for retaining small tools such as putty knives 26, 28 and 30 on the bottom blade surface 12B. The clips or other retaining means may be fixed to the bottom blade surface 12B by welding, riveting, bolting or other suitable means for attaching such clips to the bottom surface of the blade. In the preferred embodiment 10 (or 10') which utilizes clips 16, 18 and 20, no other complimentary apparatus is required for fixing the putty knives 26, 28 and 30 to the spring clips 16, 18 and 20. However if VELCRO® (hook and loop), magnetic or other retaining means is utilized instead of the spring clips, then a complimentary attachment material, such as a loop fabric, a ferrous or magnetic material, a bayonet fitting or hole for a mushroom clip may be required to be attached or inserted within the handle of the putty knives 26, 28 and 30. In a particularly preferred embodiment contemplated by the present invention the largest diameter of the blade 12 is approximately 13 inches, and the spring clip retaining means 16, 18 and 20 are circumferentially arranged about handle 14 on the bottom blade surface 12B approximately 120° apart and arranged at a radial distance of 3½ inches, 4½ inches and 5 inches, respectively, from the central axis of handle 14.

The blade 12 may be made of any non-corrodible material, such as stainless steel, composite, aluminum, polypropylene, polyethylene, wood or other material suitable for supporting plaster or spackling compound. The surface of blade 12 may be painted or it may be coated with non-stick material such as TEFLON® or other non-stick coating material. As illustrated in FIGS. 1, 3, and 7A–7E the shape of blade 12 can be octagonal, pentagonal, rectangular, hexagonal, triangular or it may have an irregular shape, such as a painter's pallet, or the blade may be in other shapes depending the preference of the manufacture and/or user.

Figure 4A:
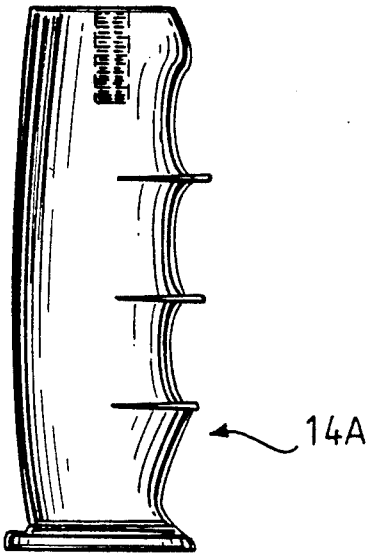
FIGS. 4(A)–4(C) show three elevations views 4(A), 4(B), and 4(C) illustrating three different handles suitable for use in the present invention.
Figure 4B:
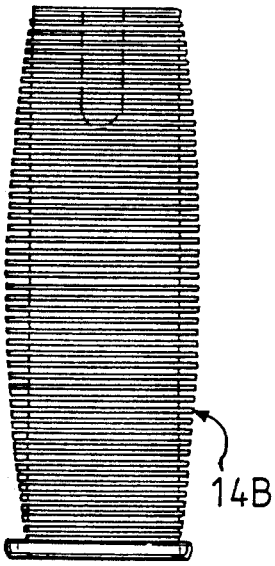
Figure 4C:
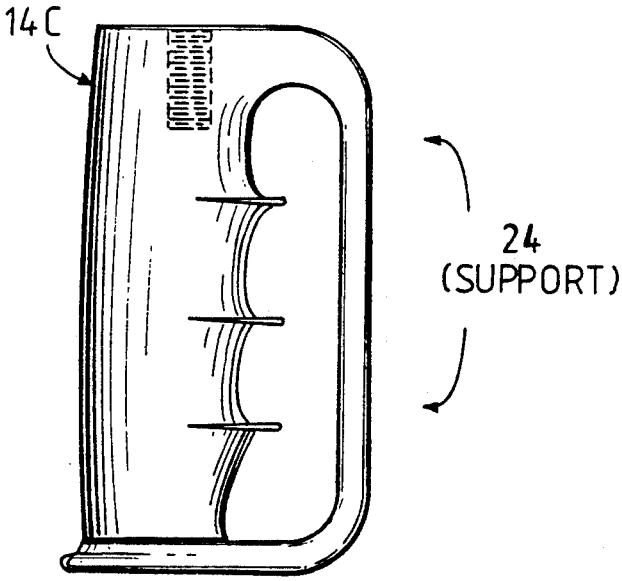

The handle 14 is preferably contoured to fit the hand of the user such as the pistol grip shape illustrated in FIGS. 1, 2 and 4A with a rubber or other resilient soft coating as illustrated in FIGS. 3 and 4. Optionally, the handle may be symmetrical as shown in FIG. 4B or it may be a pistol grip shape. The handle is preferably threaded in its upper-most portion along its longitudinal axis to allow a bolt 32 or other retaining means extending from the bottom blade surface of 12B into the handle 14. The preferred handle 14 of the present invention is made of injection molded plastic or soft rubber for comfort. The additional hand support 24 (shown in FIG. 4C) is designed like a handle for a ski pole to allow the fingers of the users to be snugly held against between the handle 14B and the support 24.

Figure 5:
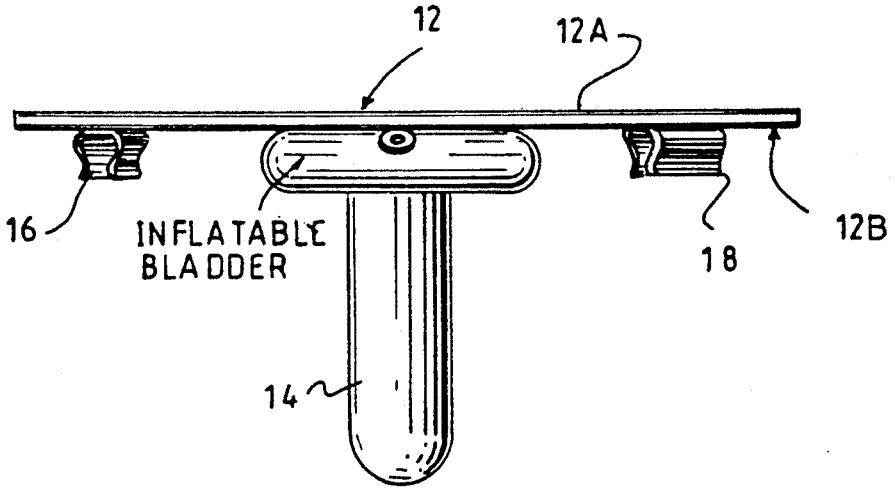
FIG. 5 is a front elevational view of a plasterer's hawk according to the present invention which includes an inflatable bladder between the mounting surface of the blade and the top end of the handle.
Figure 6:
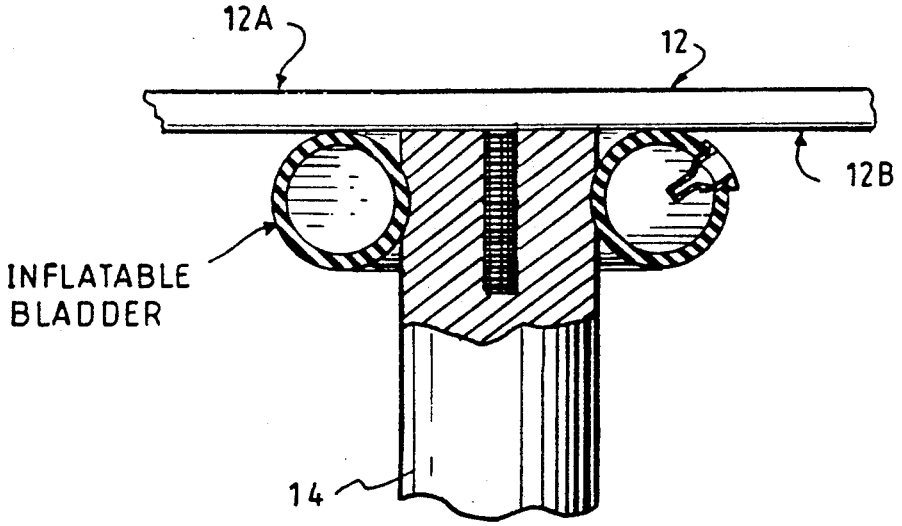
FIG. 6 is an enlarged partial cross sectional view taken along the vertical axis of the plasterer's hawk illustrated in FIG. 5.

A foam rubber gasket 22, made from soft and/or foamed rubber or other padding material is preferably placed between the upper most portion of the handle 14 and the bottom blade surface 12B to protect the user's hand from contacting the bottom blade surface 12B. The gasket 22 may be modified as disclosed in U.S. Pat. No. 1,348,516, or other protective apparatus may be used instead, such as the inflatable bladder shown in FIGS. 5 and 6 and described in more detail in U.S. Pat. No. 4,753,471.

The preferred plaster hawk 10 (or 10') of the present invention is both a tool and a tool carrier in one. The clips 16, 18 and 20 and optionally a fourth retaining means (not shown) or other retaining means hold the putty or spackling knives circumferentially on the bottom blade surface 12B. Although three (3) clips are illustrated, 2, 3, 4 or more clips can be arranged circumferentially on the bottom bade surface 12B to allow the retention of a plurality of putty or spackling knives, as well as other tools to the plasterer's hawk.

The entire plasterer's hawk 10 (or 10') can be easily dismantled, washed and then reassembled while retaining the spackling tools in the respective clips for ease of storage in a work-shop or truck of the user.

Thus, when a worker is plastering or repairing high walls or ceilings and is balanced on a ladder or scaffolding, he or she does not have to reach down the ladder or go to the tool box to change putty or spackling knives. The Plasterer's hawk saves both time and money, and enhances the safety of the user who may be placed in an uncomfortable or dangerous position when reaching down for his spackling or plastering knives.

Thus, while I have described what are the presently contemplated preferred embodiments of the present invention, other changes and modifications may be made by those skilled in the art without departing for the scope of the invention, and I have contemplated to claim all such changes and modifications.

I claim:

1. A plasterer's hawk comprising:

a blade having a flat working surface and a mounting surface opposite to said working surface, the working surface being capable of holding plaster, morter or spackling material;

a handle having a top end mounted to said mounting surface, the handle having a longitudinal axis which is substantially perpendicular to said working surface; and, a plurality of retaining means circumferentially attached to said mounting surface about said handle, said retaining means adapted for removably retaining a plurality of spackling or plastering tools.

2. A plasterer's hawk according to claim 1, wherein said retaining means includes spring clips.

3. A plasterer's hawk according to claim 1, wherein said handle is mounted at the center of said mounting surface.

4. A plasterer's hawk in accordance to claim 1, wherein said handle to removably connected to said blade.

5. A plasterer's hawk in accordance to claim 4, wherein said handle is threadably connected to said blade.

6. A plaster hawk in accordance to claim 1, wherein the shape of said blade is selected from the group consisting of circular, elliptical, square, rectangular, triangular, hexagonal, pentagonal, octagonal and irregular shapes.

7. A plasterer's hawk in accordance to claim 1, wherein said handle is shaped as a pistol grip.

8. A plasterer's hawk in accordance to claim 1, wherein said handle is symmetrical about its longitudinal axis.

9. A plasterer's hawk in accordance to claim 1, wherein said handle further includes hand supporting means to hold the fingers of the user against the handle.

10. A plasterer's hawk in accordance to claim 1, wherein said blade is made from a material selected from the group consisting of steel, stainless steel, aluminum, wood, plastic, polypropylene, polyethylene, fiber glass and composite material.

11. A plasterer's hawk in accordance to claim 1, wherein the blade is coated with a coating selected from the group consisting of paint, plastic, TEFLON ® and non-stick material.

12. A plasterer's hawk in accordance to claim 1, further comprising a resilient padding means between the mounting surface of said blade and the top end of said handle.

13. A plasterer's hawk in accordance with of claim 12, wherein said padding means is a material selected from the group consisting of foam rubber, soft rubber, felt, foam or plastic and mixtures thereof.

14. A plasterer's hawk in accordance with claim 13, wherein said padding means is configured as an inflatable bladder.

15. A plasterer's hawk in accordance with claim 13, wherein said padding means is mounted co-axially with said longitudinal axis of the handle.

* * * * *